US009095223B2

(12) United States Patent
Revell

(10) Patent No.: US 9,095,223 B2
(45) Date of Patent: Aug. 4, 2015

(54) INTEGRATED BED AND TRAMPOLINE APPARATUS

(71) Applicant: Olivia Revell, Napa, CA (US)

(72) Inventor: Olivia Revell, Napa, CA (US)

( * ) Notice: Subject to any disclaimer, the term of this patent is extended or adjusted under 35 U.S.C. 154(b) by 0 days.

(21) Appl. No.: 13/917,825

(22) Filed: Jun. 14, 2013

(65) Prior Publication Data

US 2014/0366268 A1 Dec. 18, 2014

(51) Int. Cl.
*A47C 19/00* (2006.01)
*A47C 23/00* (2006.01)
*A63B 5/11* (2006.01)

(52) U.S. Cl.
CPC ..... *A47C 23/007* (2013.01); *A63B 5/11* (2013.01)

(58) Field of Classification Search
CPC ..... A47C 19/00; A47C 23/00; A63B 5/11
USPC ..... 5/110–117; 482/27–31
See application file for complete search history.

(56) References Cited

U.S. PATENT DOCUMENTS 7,431,679 B1 * 10/2008 Tageant ..... 482/27
8,347,430 B2 * 1/2013 Malouf et al. ..... 5/484
2008/0090704 A1 * 4/2008 Denis et al. ..... 482/28

* cited by examiner

*Primary Examiner* — Fredrick Conley
(74) *Attorney, Agent, or Firm* — Dale J. Ream

(57) ABSTRACT

A bed and trampoline apparatus includes a frame having a pair of opposed upstanding side walls and a pair of upstanding end walls extending between opposed ends of the side walls, the side walls and the end walls collectively defining an interior area and an open top that provides access to the interior area. The side walls and end walls collectively include an inner surface that defines a channel extending thereabout. A mattress is positioned in the interior area. A plurality of springs are spaced apart and situated in the channel, each spring having a first end coupled to one of a respective side wall or respective end wall and a second end coupled to the mattress so as to suspend the mattress proximate the channel.

10 Claims, 8 Drawing Sheets

INTEGRATED BED AND TRAMPOLINE APPARATUS

BACKGROUND OF THE INVENTION

This invention relates to trampolines and, more particularly, to an integrated bed and trampoline apparatus 10 that includes a mattress suitable for sleeping and which is configured to be jumped on as a trampoline.

A trampoline is a strong fabric stretched tightly over a framework by numerous tightly coiled springs that enables users to jump up and down repeatedly and freely for entertainment or athletic benefit. A trampoline enables users to jump higher and with less effort than jumping on a non-spring loaded surface. Historically, trampolines have been relatively large steel frames suitable for being positioned in a residential backyard for use by kids and families to engage in high intensity exercise and exhilarating fun. It is well known that children often desire to use their beds as a trampoline. For instance, a child frequently jumps up and down on his or her mattress until urged not to do so by a parent.

Although somewhat effective at enabling children to jump up and down in a trampoline manner, traditional mattresses and bed frames are not configured to be durable enough to be repeatedly jumped on by children and, if made in the configuration of a trampoline, would not be effective for use for sleeping.

Therefore, it would be desirable to have a bed having a mattress suitable for sleeping that is also configured in the manner of a trampoline to allow repeated jumping up and down. Further, it would be desirable have a bed and trampoline so that children can enjoy the exercise and enjoyment of a trampoline from inside their own room and then to sleep on the same apparatus.

SUMMARY OF THE INVENTION

An integrated bed and trampoline apparatus according to the present invention includes a frame having a pair of opposed upstanding side walls and a pair of upstanding end walls extending between opposed ends of the side walls, the side walls and the end walls collectively defining an interior area and an open top that provides access to the interior area. The side walls and end walls collectively include an inner surface that defines a channel extending thereabout. A mattress is positioned in the interior area. A plurality of springs are spaced apart and situated in the channel, each spring having a first end coupled to one of a respective side wall or respective end wall and a second end coupled to the mattress so as to suspend the mattress proximate the channel.

Therefore, a general object of this invention is to provide an integrated bed and trampoline apparatus, that includes a mattress configured for sleeping but also for use as a trampoline.

Another object of this invention is to provide an integrated bed and trampoline apparatus, as aforesaid, that includes a mattress situated within an interior area defined by a frame and suspended by a plurality of coiled springs.

Still another object of this invention is to provide an integrated bed and trampoline apparatus, as aforesaid, in which the plurality of springs are situated within a channel defined by an inner surface of the frame so as to prevent inadvertent contact with a person.

Yet another object of this invention is to provide an integrated bed and trampoline apparatus, as aforesaid, having a protective skirt positioned to prevent unintentional access to the channel and springs.

A further object of this invention is to provide an integrated bed and trampoline apparatus, as aforesaid, having the appearance of a traditional bed.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
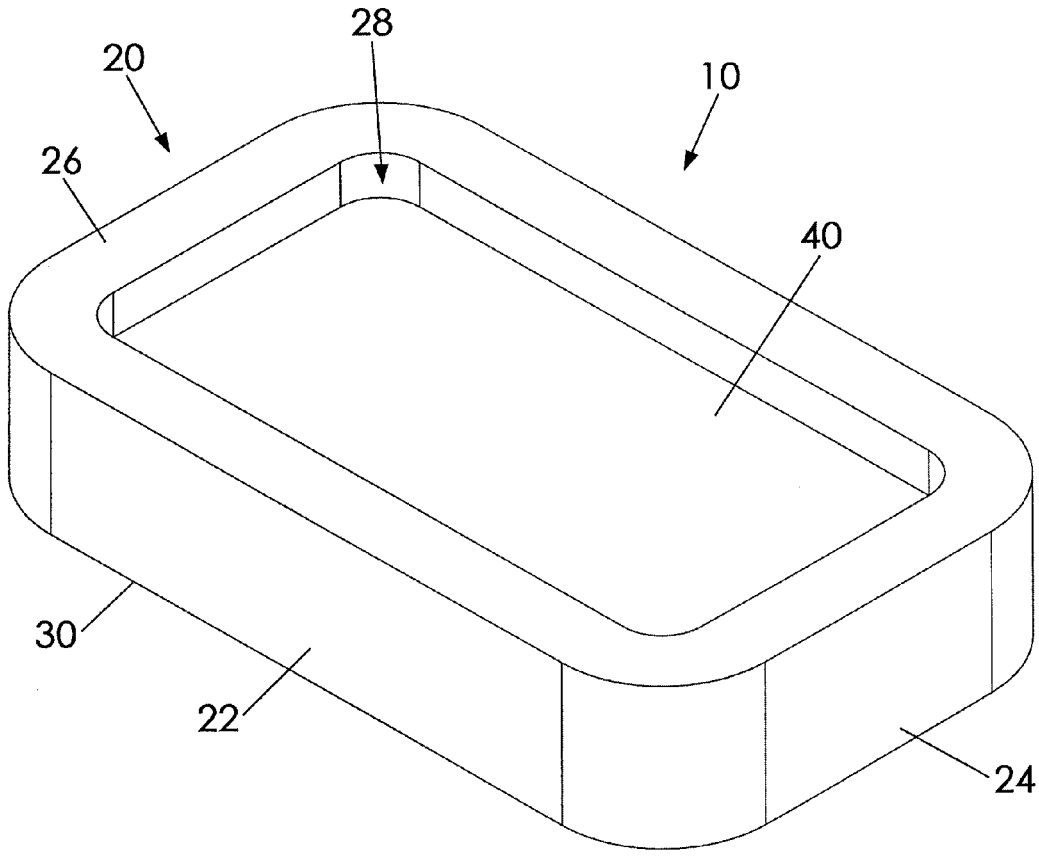
FIG. 1 is a perspective view of an integrated bed and trampoline apparatus according to one embodiment of the present invention.

A bed and trampoline apparatus according to a preferred embodiment of the present invention will now be described with reference to FIGS. 1 to 7*b* of the accompanying drawings. The integrated bed and trampoline apparatus 10 includes a frame 20, a mattress 40, and a plurality of springs 50.

The frame 20 includes a plurality of upstanding walls arranged in a generally rectangular configuration and sized in order to hold a mattress suitable for sleeping. More particularly, the frame 20 may include a pair of opposed upstanding side walls 22 each having opposed ends. The frame 20 includes a pair of opposed upstanding end walls 24 extending between respective ends of respective end walls 24. Together, the upstanding side 22 and end 24 walls define an interior area. An upper edge 26 of the frame 20 defines an open top 28 that provides access to the interior area. In one embodiment, a lower edge of the frame 20 defines an open bottom 32 that provides access to the interior area of the frame 20. Alternatively, one embodiment of the frame 20 may include a closed bottom wall (not shown).

Figure 2B:
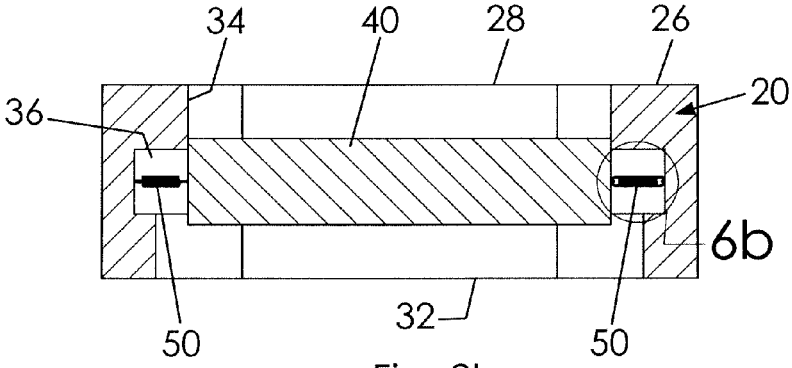
FIG. 2*b* is a sectional view taken along line 2*b*-2*b* of FIG. 2*a;*
Figure 3A:
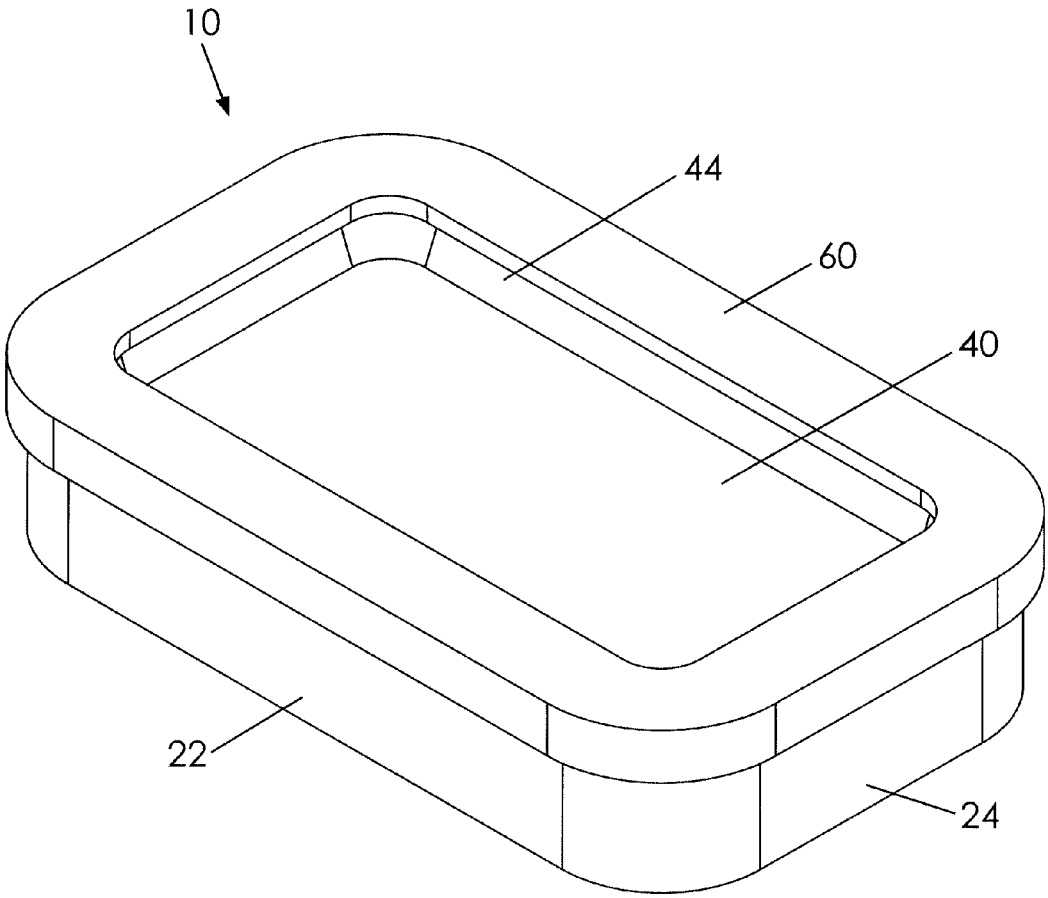
FIG. 3*a* is a perspective view of a bed and trampoline apparatus according to another embodiment of the present invention.

The end walls 24 and side walls 22 of the frame 20 together include an inner surface 34. The inner surface 34 defines a channel 36 in the form of a generally U-shaped recess (FIG. 2*b*) that extends completely about the inner surface (FIG. 3). The channel 36 is lowerly displaced from the upper edge 26 and upwardly displaced from the lower edge 30. Preferably, the channel 36 is positioned midway between the upper edge 26 of the frame 20 and the lower edge 30 of the frame 20 as will become apparent later.

Figure 6A:
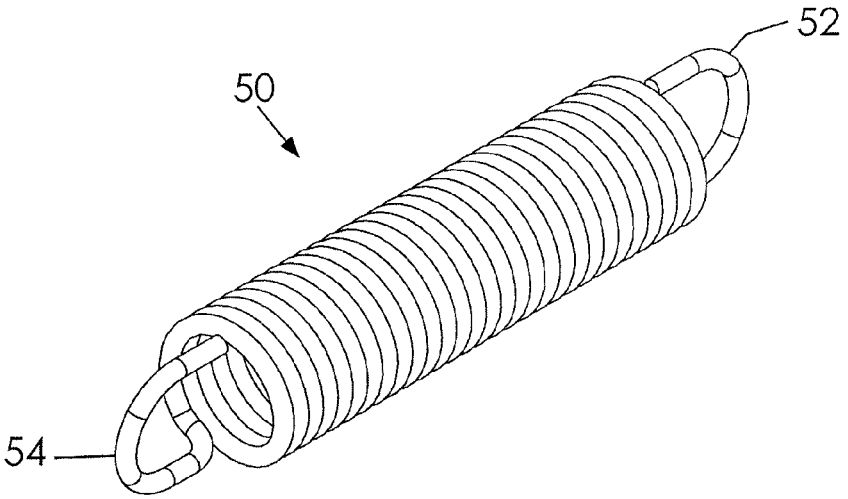
FIG. 6*a* is an isolated view on an enlarged scale taken from FIG. 3*b;*
Figure 6B:
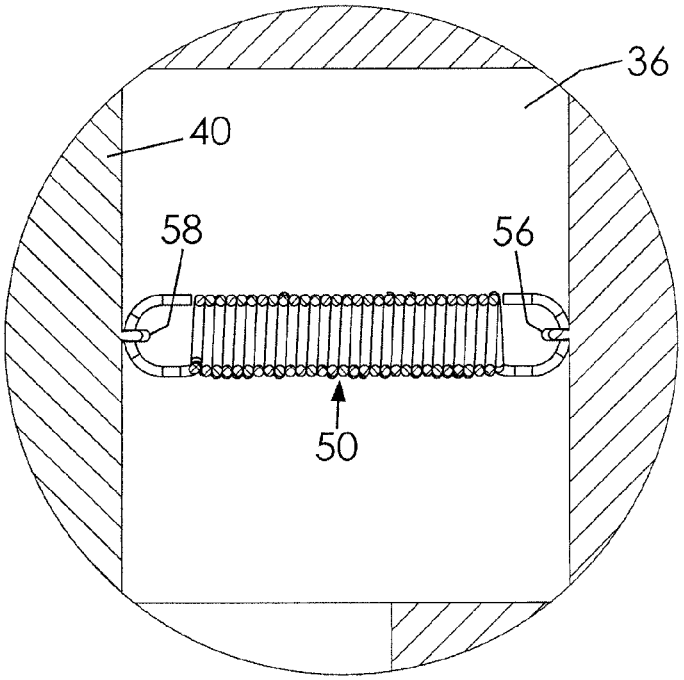
FIG. 6*b* is an isolated view on an enlarged scale taken from FIG. 2*b;*

The mattress 40 is positioned in the interior area of the frame 20 and is held therein as will be explained below. The integrated bed and trampoline apparatus 10 includes a plurality of springs 50 spaced apart from one another (FIG. 3). Each spring 50 is situated in the channel 36 and is configured to suspend the mattress 40 in the interior area proximate the channel 36 (FIG. 6*b*).

Figure 7A:
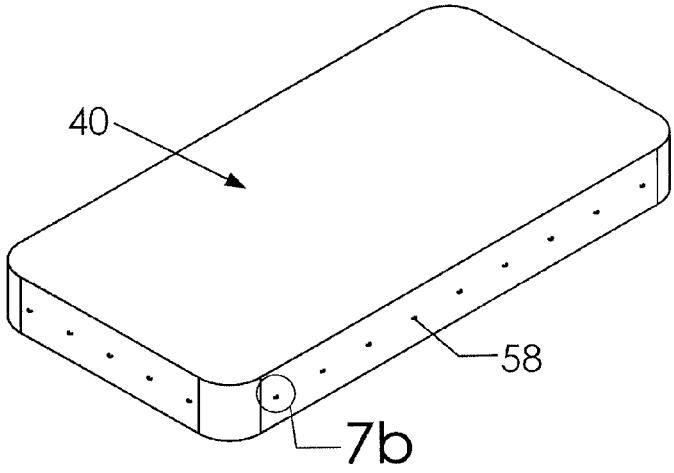
FIG. 7*a* is a perspective view of a mattress removed from FIG. 3*b*.
Figure 7B:
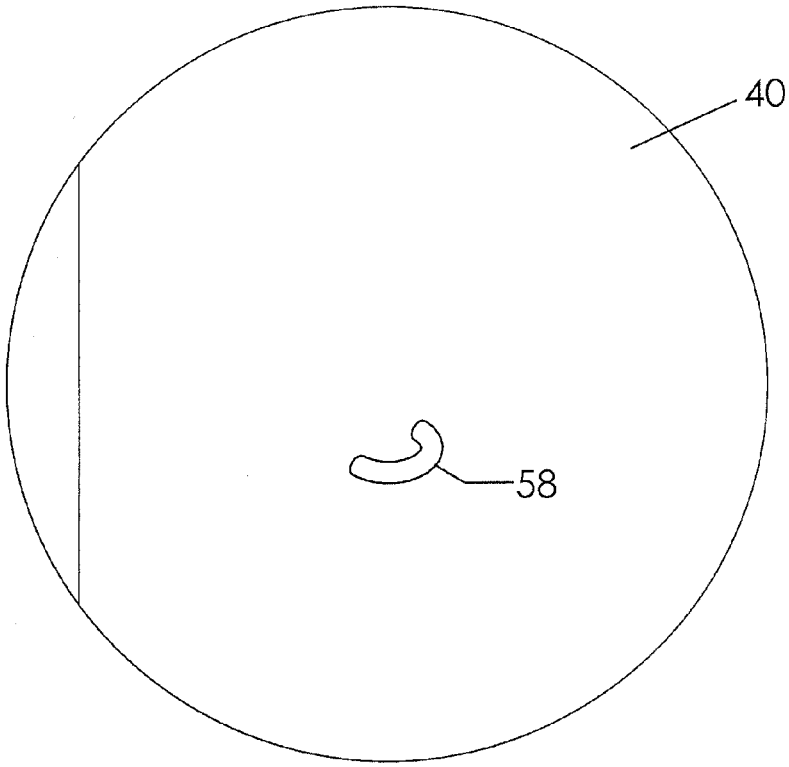
FIG. 7*b* is an isolated view on an enlarged scale taken from FIG. 7*a.*

More particularly, each spring 50 is a torsion spring and includes a first end 52 coupled to the inner surface of either a frame side wall 22 or frame end wall 24, respectively. Each spring 50 also includes a second end 54 coupled to the mattress 40. A plurality of wall mounting fasteners 56, such as D-rings, may be connected to respective walls within the channel 36 (FIG. 6*b*). The first end 52 of a spring 50 may include a hook that may be selectively coupled to a wall mounting fastener 56. Similarly, a plurality of mattress mounting fasteners 58 may be spaced apart and coupled to a peripheral edge of the mattress 40, each mattress mounting fastener 58 being selectively coupled to a respective second end 54 of a respective spring 50 (FIGS. 6*b* and 7*b*). Accordingly, the plurality of springs 50 may be uncoupled from respective mattress mounting fasteners 58 so that a mattress 40 may be removed and/or replaced. Further, the mattress 40 may be enclosed in a containment member 42 such as a bag constructed of reinforced plastic (FIGS. 4*b* and 4*c*).

Figure 3B:
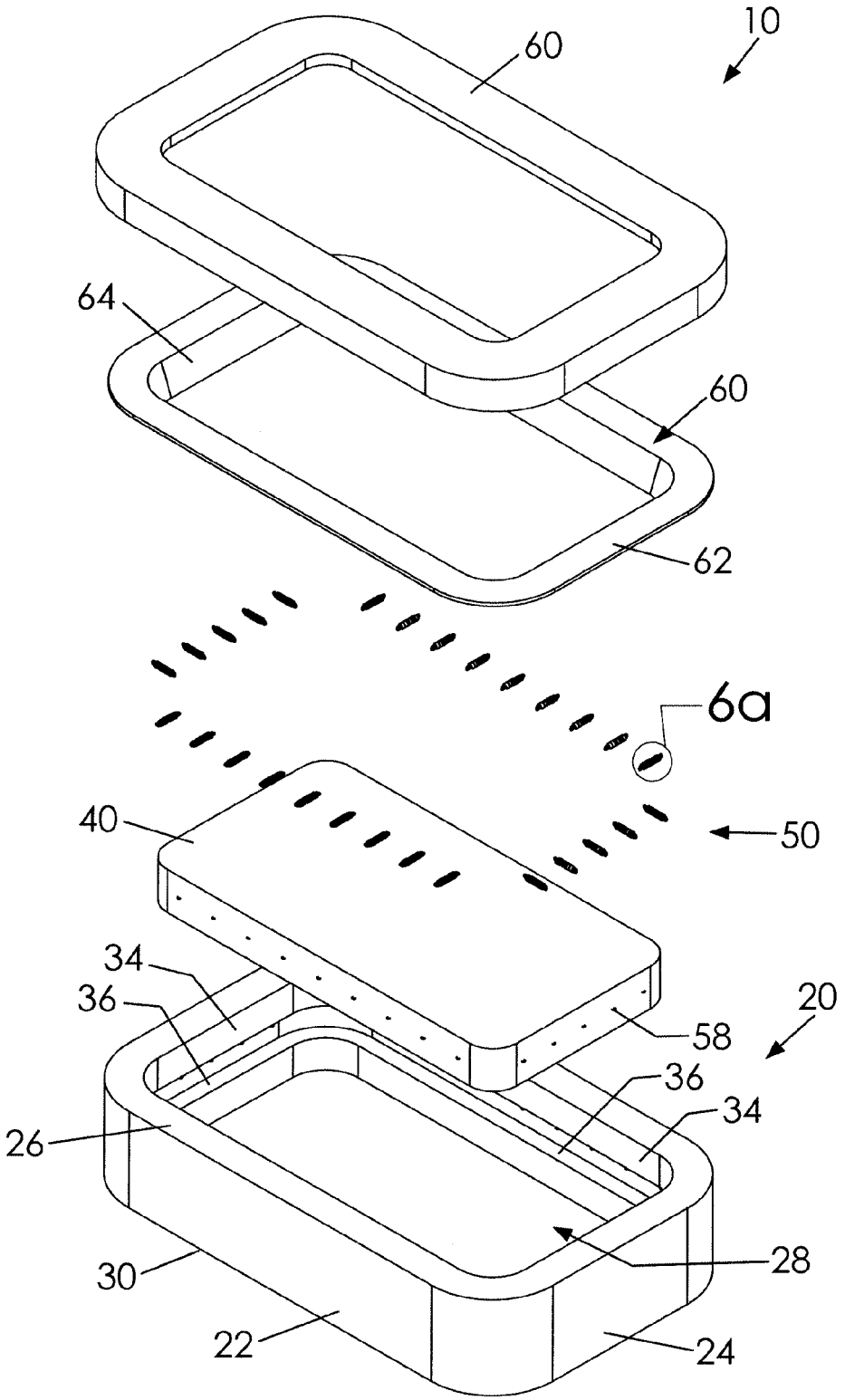
FIG. 3*b* is an exploded view of the integrated bed and trampoline apparatus of FIG. 3*a;*
Figure 5A:
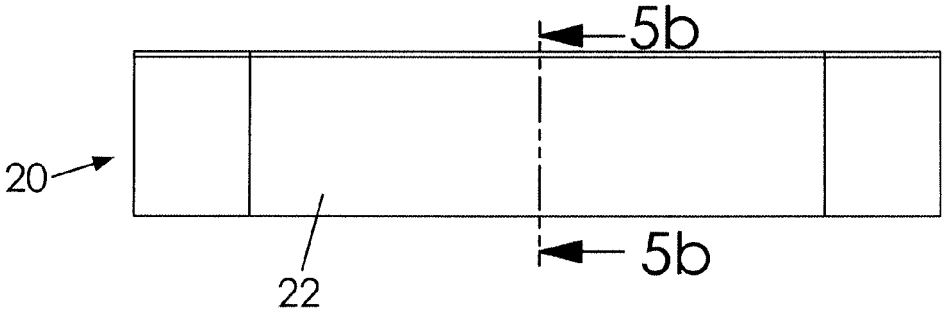
FIG. 5*a* is a side view of the integrated bed and trampoline apparatus of FIG. 3*a* with the protective pad removed.
Figure 5B:
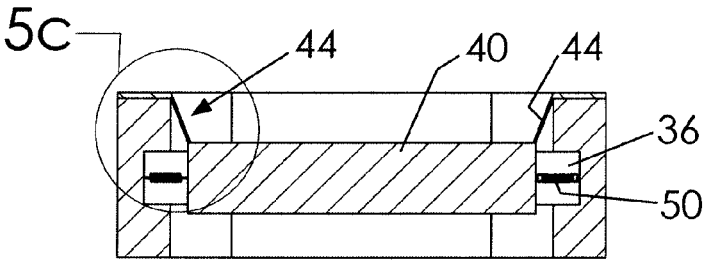
FIG. 5*b* is a sectional view taken along line 5*b*-5*b* of FIG. 5*a;*
Figure 5C:
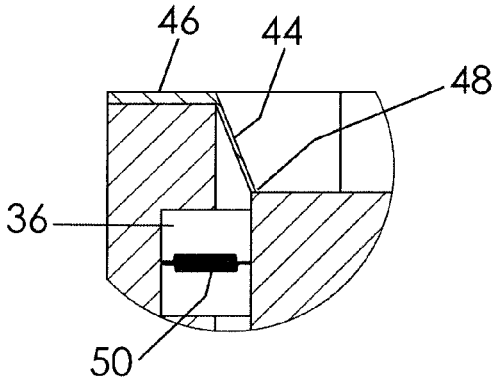
FIG. 5*c* is an isolated view on an enlarged scale taken from FIG. 5*b;*

In one embodiment, the integrated bed and trampoline apparatus 10 includes a skirt 44 that prevents access to the channel 36 and, as a result, to the springs 50 within the channel 36. The skirt 44 is a safety feature that prevents a child from accidentally having a hand or foot come into contact with the torsion springs 50 while sitting or sleeping on the mattress 40 or, of course, while using the mattress 40 as a trampoline. The skirt 44 may have a first edge 46 coupled to a top of a respective end wall 24 or side wall 22 of the frame 20 and a second edge 48 coupled to a top or side of the mattress 40 (FIG. 5*c*). The skirt 44 is intended to extend completely around the inner periphery of the frame 20 and mattress 40 (FIG. 3*b*). The skirt 44 may be constructed of an elastic material so that it will be resilient if contacted by a user while jumping on the mattress 40.

Figure 4A:
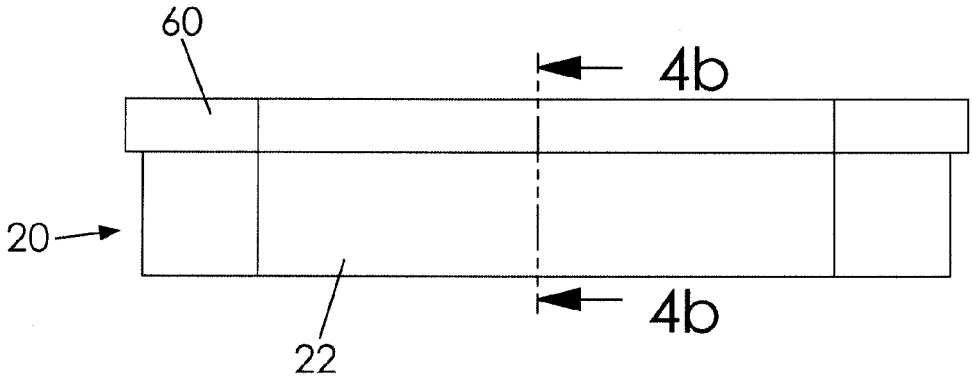
FIG. 4*a* is a side view of the integrated bed and trampoline apparatus of FIG. 3*a;*
Figure 4B:
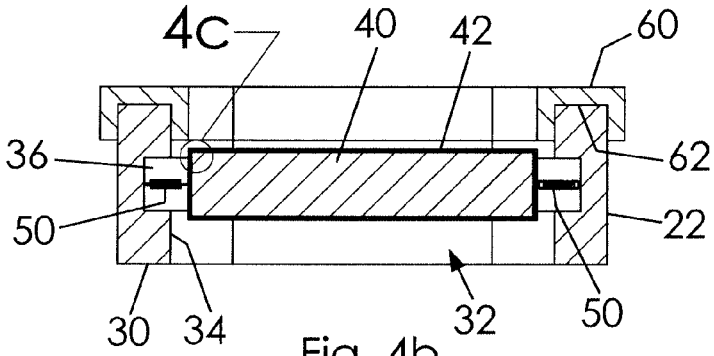
FIG. 4*b* is a sectional view taken along line 4*b*-4*b* of FIG. 4*a;*
Figure 4C:
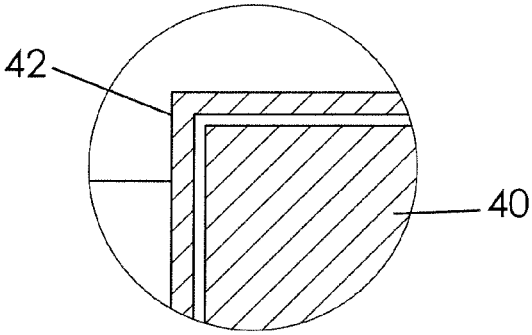
FIG. 4*c* is an isolated view on an enlarged scale taken from FIG. 4*b;*

In one embodiment, a protection member 60 may be selectively coupled to the upper edge 26 of the frame 20 and configured to protect a user from injury that may be caused by a fall against the frame 20 while jumping on the mattress 40 (FIGS. 3, 4*a*, and 4*b*). The protection member 60 may be constructed of a resilient material such as a foam pad configured to decrease an impact force that may be experienced by a person falling on the frame 20. The protection member 60 may include a bottom surface that defines a recess 62 having a generally inverted U-shaped configuration that is selectively received atop the upper edge 26 of the frame 20, such as in a friction fit engagement. In this embodiment, the protection member 60 may be selectively used or removed from the frame 20 at the user's discretion.

Figure 2A:
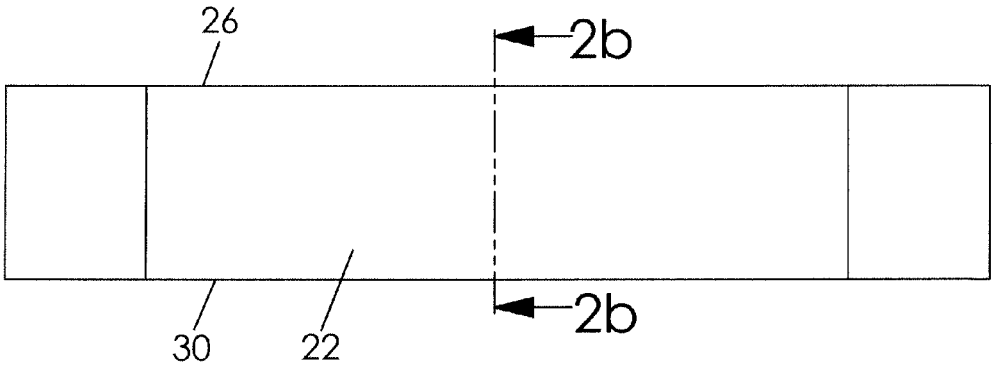
FIG. 2*a* is a side view of the integrated bed and trampoline apparatus of FIG. 1.

In other embodiments, the integrated bed and trampoline apparatus 10 does not include a protection member. FIGS. 2, 2*a*, and 2*b* illustrate this embodiment.

In use, a mattress 40 may be initially installed in the apparatus 10 by coupling the plurality of springs 50 to corresponding mattress mounting fasteners 58 around the edge of the mattress 40. Once installed, a user, such as a child, may jump on the mattress 40. As weight is applied upon the mattress 40, respective torsion springs 50 expand to absorb the force. The mattress 40 has room in the interior area of the frame 20 to move moderately up and down as it is jumped on. The mattress 40 is easily removed if it is desired to be removed and replaced.

It is understood that while certain forms of this invention have been illustrated and described, it is not limited thereto except insofar as such limitations are included in the following claims and allowable functional equivalents thereof.

The invention claimed is:

1. An integrated bed and trampoline apparatus, comprising:

a frame having a pair of opposed upstanding side walls and a pair of upstanding end walls extending between opposed ends of said side walls, said side walls and said end walls collectively defining an interior area and an open top that provides access to said interior area;

wherein:

said side walls and said end walls collectively include an inner surface that defines a generally U-shaped channel extending thereabout;

said frame defines an open bottom;

said channel is downwardly displaced from said open top and upwardly displaced from said open bottom;

a mattress positioned in said interior area; and a plurality of springs spaced apart and positioned in said channel, each spring having a first end coupled to one of a respective side wall or a respective end wall and a second end coupled to said mattress so as to suspend said mattress proximate said channel and above said open bottom.

2. The integrated bed and trampoline apparatus as in claim 1, wherein said mattress has a singular and inseparable configuration that is configured for selectively being jumped on and slept on.

3. The integrated bed and trampoline apparatus as in claim 1, further comprising a skirt having a first edge coupled to a top of a respective wall of said frame and a second edge coupled to said mattress, said skirt extending peripherally about said top of said respective walls of said frame so as to prevent access to said channel.

4. The integrated bed and trampoline apparatus as in claim 3, wherein said skirt is constructed of an elastic material.

5. The integrated bed and trampoline apparatus as in claim 1, further comprising:

a plurality of wall mounting fasteners coupled to said inner surface of said side walls and said end walls of said frame, each wall mounting fastener configured to selectively engage a respective first end of a respective spring; and a plurality of mattress mounting fasteners coupled to a peripheral edge of said mattress, each mattress mounting fastener configured to selectively engage to a respective second end of a respective spring.

6. The integrated bed and trampoline apparatus as in claim 1, wherein each spring is a torsion spring.

7. The integrated bed and trampoline apparatus as in claim 1, further comprising a protection member coupled to an upper edge of said frame, said protection member having a generally rectangular configuration and constructed of a resilient material.

8. The integrated bed and trampoline apparatus as in claim 7, wherein said protection member is a foam pad configured to decrease an impact force experienced by a person falling onto said frame.

9. The integrated bed and trampoline apparatus as in claim 7, wherein said protection member has a bottom surface that defines a recess having an inverted U-shaped configuration that is selectively received atop said upper edge of said frame in a friction fit engagement.

10. The integrated bed and trampoline apparatus as in claim 1, wherein said mattress is enclosed in a containment member constructed of reinforced plastic.

* * * * *